US009492358B2

(12) United States Patent
Lee

(10) Patent No.: US 9,492,358 B2
(45) Date of Patent: Nov. 15, 2016

(54) SILICONE BABY BOTTLE

(76) Inventor: Yong Kwon Lee, Bucheon-si (KR)

( * ) Notice: Subject to any disclaimer, the term of this patent is extended or adjusted under 35 U.S.C. 154(b) by 634 days.

(21) Appl. No.: 14/001,253

(22) PCT Filed: Feb. 27, 2012

(86) PCT No.: PCT/KR2012/001464
§ 371 (c)(1),
(2), (4) Date: Aug. 23, 2013

(87) PCT Pub. No.: WO2012/115491
PCT Pub. Date: Aug. 30, 2012

(65) Prior Publication Data

US 2013/0327737 A1 Dec. 12, 2013

(30) Foreign Application Priority Data

Feb. 25, 2011 (KR) ..... 10-2011-0017301
Sep. 16, 2011 (KR) ..... 10-2011-0093192
Feb. 27, 2012 (KR) ..... 10-2012-0019549

(51) Int. Cl.
*A61J 9/04* (2006.01)
*A61J 11/04* (2006.01)
*A61J 11/00* (2006.01)

(52) U.S. Cl.
CPC . *A61J 9/04* (2013.01); *A61J 11/04* (2013.01); *A61J 11/045* (2013.01); *A61J 11/008* (2013.01); *A61J 2200/76* (2013.01)

(58) Field of Classification Search
CPC ..... A61J 9/00; A61J 9/006; A61J 9/00; A61J 9/02; A61J 9/04; A61J 9/0623;
(Continued)

(56) References Cited

U.S. PATENT DOCUMENTS 1,669,892 A * 5/1928 Beck ..... A61J 9/04 215/11.5
2,394,722 A * 2/1946 Sloane ..... A61J 9/04 215/11.5

(Continued)

FOREIGN PATENT DOCUMENTS

DE 3317849 A1 * 11/1984
DE 3337248 A1 * 11/1984

(Continued)

OTHER PUBLICATIONS

International Search Report—PCT/KR2012/001464 dated Sep. 14, 2012.

*Primary Examiner* — J. Gregory Pickett
*Assistant Examiner* — Brijesh V. Patel
(74) *Attorney, Agent, or Firm* — Cantor Colburn LLP

(57) ABSTRACT

A silicone baby bottle which is made of silicone which does not generate environmental hormones is disclosed. The silicone baby bottle allows an infant or young child to be safely fed. The silicon baby bottle includes a body part, a nipple, and a coupling member composed of a first coupling ring and a second coupling ring which are screwed with each other to be coupled. The body part and nipple are made of silicone which is a soft material and the coupling member is made of a rigid material so that a coupled structure of the body part and nipple can be tightly sealed. Since only the body part and nipple made of silicone are allowed to come into contact with infant formula and infant's mouth, the infant is not exposed to environmental hormones attributable to synthetic resin.

10 Claims, 15 Drawing Sheets

(58) Field of Classification Search

CPC ..... A61J 9/085; A61J 11/001; A61J 11/0015; A61J 11/002; A61J 11/0035; A61J 11/008; A61J 11/02; A61J 11/04; A61J 11/045; A61J 2200/76; A61J 2205/20; B65D 47/263; B65D 47/265; B65D 47/32; B65D 51/16; B65D 51/1672; Y10S 215/902; Y10S 220/27; Y10T 137/0396; Y10T 137/3149

USPC ..... 215/11.1–11.6, 40–55, 274, 276–277, 215/307–315, 381; 220/253, 360, 366.1, 220/DIG. 27; 137/14, 215

See application file for complete search history.

(56) References Cited

U.S. PATENT DOCUMENTS

| | | | | |
|---|---|---|---|---|
| 2,426,927 | A * | 9/1947 | Ganson | 215/11.5 |
| 2,834,496 | A * | 5/1958 | Boston et al. | 215/11.1 |
| 3,211,315 | A * | 10/1965 | Griesinger | 215/11.1 |
| 3,335,890 | A * | 8/1967 | Grundmann et al. | 215/11.1 |
| 3,777,753 | A * | 12/1973 | Kesselring et al. | 215/11.1 |
| 4,505,398 | A * | 3/1985 | Kesselring | 215/11.5 |
| 4,526,274 | A * | 7/1985 | Kesselring et al. | 206/231 |
| 4,856,995 | A * | 8/1989 | Wagner | 433/215 |
| 5,454,486 | A * | 10/1995 | Mack | B05B 11/047 222/105 |
| 5,779,071 | A * | 7/1998 | Brown et al. | 215/11.5 |
| 5,938,053 | A * | 8/1999 | Verbovszky et al. | 215/6 |
| 5,944,205 | A * | 8/1999 | LaJoie | A61J 9/04 215/11.5 |
| 5,993,479 | A * | 11/1999 | Prentiss | 606/236 |
| 6,357,620 | B1 * | 3/2002 | Hakim | 220/714 |
| 6,877,625 | B2 * | 4/2005 | Alley | 215/307 |
| 6,971,551 | B2 * | 12/2005 | Widgery | 222/129 |
| 7,225,938 | B2 * | 6/2007 | Frisch | 215/11.4 |
| 7,331,478 | B2 * | 2/2008 | Aljadi | 215/11.4 |
| 7,677,402 | B2 * | 3/2010 | Mensah-Ouvor et al. | 215/11.4 |
| 7,938,281 | B2 * | 5/2011 | Horntrich et al. | 215/11.6 |
| 8,464,882 | B2 * | 6/2013 | Tirosh | 215/11.1 |
| 8,528,756 | B2 * | 9/2013 | Itzek et al. | 215/11.4 |
| 2002/0130139 | A1 * | 9/2002 | Shiraishi | B65D 23/02 222/105 |
| 2003/0168474 | A1 * | 9/2003 | Widgery | 222/183 |
| 2007/0102451 | A1 * | 5/2007 | Pruvot | B05B 11/0016 222/189.09 |
| 2008/0128379 | A1 * | 6/2008 | Hen | 215/11.5 |
| 2009/0039049 | A1 * | 2/2009 | Horntrich et al. | 215/11.6 |
| 2009/0178940 | A1 * | 7/2009 | Said | 206/221 |
| 2009/0283536 | A1 * | 11/2009 | Libby | 220/713 |
| 2010/0072162 | A1 * | 3/2010 | Park | A61J 9/04 215/11.5 |
| 2011/0042339 | A1 * | 2/2011 | Pfenniger et al. | 215/11.5 |
| 2011/0139740 | A1 * | 6/2011 | Hakim | A61J 9/04 215/11.5 |
| 2011/0144598 | A1 * | 6/2011 | Mihashi | A61F 9/0008 604/295 |
| 2011/0155684 | A1 * | 6/2011 | Sirota | 215/11.5 |
| 2011/0180508 | A1 * | 7/2011 | Fong | A61J 9/04 215/11.5 |
| 2011/0198309 | A1 * | 8/2011 | Itzek et al. | 215/11.1 |
| 2011/0266245 | A1 * | 11/2011 | Lau | A61J 9/04 215/11.5 |
| 2011/0266246 | A1 * | 11/2011 | Itzek | 215/11.6 |
| 2011/0303629 | A1 | 12/2011 | Wong | |
| 2012/0037587 | A1 * | 2/2012 | Tirosh | 215/11.5 |
| 2012/0175335 | A1 * | 7/2012 | Itzek et al. | 215/11.1 |
| 2012/0193317 | A1 * | 8/2012 | Brown et al. | 215/6 |
| 2013/0056435 | A1 * | 3/2013 | Itzek | 215/11.5 |

FOREIGN PATENT DOCUMENTS

| | | | |
|---|---|---|---|
| DE | 29621392 | U1 * | 2/1997 |
| DE | 10157071 | C1 * | 3/2003 |
| KR | 1020050008467 | | 1/2005 |
| KR | 200382961 | | 4/2005 |
| KR | 1020080056765 | | 6/2008 |
| WO | 2010097037 | | 9/2010 |

* cited by examiner

SILICONE BABY BOTTLE

TECHNICAL FIELD

The present invention relates to a silicone baby bottle, and more particularly to a silicone baby bottle having the following advantages: the baby bottle is health-friendly because it is made of silicone which does not generate environmental hormones; a flexible body part and a flexible nipple, both made from silicone, are firmly coupled to each other by a rigid coupling ring so that hermetic sealing is obtained and infant formula is not likely to come into contact with a synthetic resin which is considered to generate environmental hormones which are hazardous to health; there is no risk that a baby is exposed to environmental hormones which are usually eluted from a synthetic resin because only the body part and nipple made from silicone come in contact with the infant mouth; and the silicone baby bottle has a mother's skin texture, which is a feature of silicone, which contributes to the baby's emotional development.

BACKGROUND ART

As is well known, a baby bottle is a tool to help infants or young children get formula needed for growth through bottle feeding instead of breast feeding. Typically the baby bottle is composed of a body part for containing infant formula, a nipple with a tap, and a coupling means for coupling the body part and the nipple to each other.

The body part is made of a transparent plastic material (i.e., synthetic resin) which is inexpensive, lightweight, and durable. The nipple is made of a soft material so that a baby can suck the infant formula via the nipple. The coupling means is coupled to the outside surface of an upper portion of the body part generally in a screw manner in order to seal the nipple to the body part.

Since germs easily stick to the baby bottle and bacteria multiply fast on the surface of the baby bottle once the baby bottle is used, the baby bottle is boiled to be sterilized so that babies will not be infected.

When sterilizing the baby bottle made of a plastic material in a boiling water, environmental hormones hazardous to babies' health are generated. The environmental hormones are transferred to baby's bodies along with the formula in the bottle, having a negative impact on the babies. The environmental hormones are also likely to be generated when hot water is poured into a synthetic resin bottle to prepare infant formula.

Meanwhile, a baby bottle made of glass is disadvantageous in that it is heavy, is not good for baby's emotional development due to its hardness, and it easily breaks even when it is made of tempered glass or heat-resistant glass.

In order to prevent hazardous environmental hormones from being generated from baby bottles, silicone-based baby bottles are proposed, such as a "silicone baby bottle" disclosed in Korean Patent Registration No. 0621163. That is, baby bottles made of silicone are increasingly being marketed. Silicone is comparatively expensive but it is highly resistant to heat and does not generate environmental hormones. For this reason, the demand for silicone baby bottles is increasing.

The baby bottle is provided with an air inlet, through which external air in a volume corresponding to the volume of formula fed to a baby is introduced in order to maintain a constant internal pressure. In conventional baby bottles, the air inlet is exposed to the outside.

When a baby is fed from the baby bottle, the tap is put into baby's mouth and the baby bottle is disposed upside down so that the formula in the baby bottle can flow into the baby's mouth. In this instance, since the air inlet is formed in the nipple and exposed directly to the outside, when the baby incidentally pauses sucking the formula during feeding, the formula in the baby bottle is usually discharged outside by backflow through the air inlet due to the increased pressure of the infant formula in the nipple. This discharged formula flows along the surface of the baby bottle and drops onto the baby's face, surprising or displeasing the baby. This discharged formula is easily exposed to germs and the baby is likely to be infected by the germs by accidentally consuming the formula on the surface of the baby bottle.

Accordingly, it is necessary to minimize the outflow of the formula through the air inlet when the baby pauses sucking the formula in the baby bottle during feeding and to prevent the formula from flowing along the surface of the baby bottle and dropping to the baby's face or mouth even when the backflow of the formula occurs.

It is also necessary to provide components of the baby bottle, i.e. body part, nipple and coupling means, as separate members in order for easy removal of foreign substances sticking to the baby bottle, and easy cleaning and boiling for disinfection. Furthermore, it is preferable that the components can be easily reassembled after being disassembled for cleaning and can be tightly sealed without allowing a gap between the components so that the formula will not leak through the gap after being reassembled.

Furthermore, since silicone is soft and easily deformable by external force, it is difficult to tightly reassemble the components of the baby bottle and thus unintended gaps may occur between the components after being reassembled.

Especially in the case of a baby bottle such as the "silicone baby bottle" disclosed in Korean Patent Registration No. 0621163 in which a coupler as the coupling means simply couples to the outer circumference of an opening of a body part of the bottle made of silicone in an inserted manner and a tap cover as the coupling means couples to the coupler in a screw manner, the opening of the body part of the baby bottle is simply inserted into the coupler and there are no other means to tightly couple the coupler and the body part to each other. Accordingly, when the coupler and the cover are screwed together or unscrewed from each other, the coupler and the body part are not tightly fitted to each other. That is, in even a state in which the opening portion of the body part is inserted into the coupler, the body part can be rotated. This hinders not only tight coupling between the coupler when assembling the baby bottle but also separation of the coupler and the body part when disassembling the baby bottle.

Furthermore, when assembling a baby bottle, a user holds a body part with one hand and rotates a cover with other hand in order to couple the body part and the cover in a screw manner. At this time, the body part is deformed by external force applied from user's hand and the cover is coupled to the body part in the deformed state. Accordingly, there is a possibility that a gap may occur in the contact site of the body part and the cover.

Furthermore, since silicone is soft, when the body part is pressed by user's hand, the cover or the coupler screwed with the body part is likely to be easily separated from the body part.

If this happens during feeding, the safety of the infant or young child cannot be secured.

Accordingly, when the baby bottle is made of silicone, the body part and the nipple need to be easily and simply coupled and decoupled by the coupling means, while ensuring secure coupling without allowing a gap between the body part and nipple when the body part and the nipple are coupled to each other. However, the conventional silicone baby bottle is not provided with such a coupling means.

DISCLOSURE

Technical Problem

Accordingly, the present invention has been made keeping in mind the above problems occurring in the prior art, and an object of the present invention is to provide a silicone baby bottle in which tight coupling between components and safety are ensured because a body part and a nipple are made of silicone which does not generate environmental hormones, and because the body part and nipple are structured to be in tight contact with each other in consideration of the limitations of silicone representing elastomer, in order to prevent the components, except for the body part, from being separated from the body part by incidental external force, preventing formula in the silicone baby bottle from leaking and flooding which results in an infant or a young child becoming dirty or burned.

Another object of the present invention is to provide a silicone baby bottle not only which has a good appearance and can be produced in mass production with good productivity but also which has a structure in which a body part and a nipple can come into tight contact with each other.

A further object of the present invention is to provide a silicone baby bottle in which an air inlet is not formed in a nipple but in a body part in order to lower the inside pressure near the air inlet and thus lower a possibility that formula in the body part is discharged through the air inlet, and in which the air inlet is covered by a first coupling ring in order to prevent the formula from flowing along the surface of the body part even if the formula is discharged through the air inlet. This prevents an infant or a young child from being displeased or from being infected by germs.

Yet another object of the present invention is to provide a silicone baby bottle in which all components can be separated from each other in order to ensure easy cleaning and disinfection in boiling water, and all the components can be tightly reassembled after the cleaning and disinfection process.

Technical Solution

In order to accomplish the above objects, the present invention provides a silicone baby bottle including: a body part made of elastomer and composed of a neck portion with an upper locking portion and a shoulder portion provided at a lower portion of the neck portion; a nipple made of elastomer and composed of a flange coming into contact with an upper surface of the body part, a waist portion extending from an upper portion of the flange, and a tap extending from an upper portion of the waist portion; and a coupling part which tightly couples the body part and the nipple to each other and is composed of a first coupling ring and a second coupling ring screwed with the first coupling ring and configured to cover an upper surface of the flange of the nipple, the first coupling ring being provided between the shoulder portion of the body part and the upper locking portion of the neck portion.

In the silicone baby bottle, the nipple may be provided with a recess between the flange and the waist portion and the second coupling ring has a pushing portion to be inserted into the recess.

The waist portion of the nipple may be thicker than the other portions of the nipple in order to impart rigidity and reinforce supportability, and the pushing portion of the second ring may protrude inward from the inside surface and the pushing portion is disposed between a lower portion of the waist portion of the nipple and the recess.

In the silicone baby bottle according to the present invention, the upper locking portion of the neck portion includes a side extension extending from an upper end of the body part in the radial direction and a lower extension extending downward from an end of the side extension and surrounding an upper end of the first coupling ring.

The upper end of the first coupling ring is locked by the upper locking portion of the body part.

The shoulder portion of the body part is thicker than the remaining portion of the body part in order to impart rigidity and reinforce supportability.

The first coupling ring includes an insertion portion at an upper end.

The upper locking portion of the body is provided with a recessed portion into which the insertion portion is inserted.

An inside surface of the second ring is provided with a pressing portion which directly presses the upper locking portion of the neck portion of the body part when the first coupling ring is coupled.

The first ring is provided with a coupling direction indicating mark, and an air inlet through which air is externally introduced into the body part during feeding is formed in a mounting recess of the neck portion of the body part which is surrounded by the first coupling ring.

Advantageous Effects

According to the silicone baby bottle having the structure described above according to the present invention, since the body part and the nipple are made of silicone, an infant or young child can be protected from environmental hormones.

Especially when the first coupling and the second coupling are coupled to each other, the pressing portion of the second coupling presses the upper surface of the lower extension (or the side extension, or the lower extension and the side extension) of the body part and simultaneously the pushing portion of the second coupling ring presses the upper surface of the flange of the tap. Accordingly, the body part and the nipple come into tight contact with each other inside the baby bottle.

Components except for the body part are not easily separated from each other by an external force because of the advantageous properties of silicone representing elastomer, and the silicone baby bottle is safe in terms of user's health.

Since this silicone baby bottle is excellent in sealing above all, there is no risk that the contents in the bottle leak or flood, preventing the user from becoming dirty or burned.

Furthermore, since only the body part and nipple made of silicone come into contact with infant or young child formula or baby's mouth, the infant or young child using the baby bottle is not exposed to environmental hormones which are generated from synthetic material or similar hazardous substances. Yet furthermore, the silicone provides the infant or young child with mother's skin-like feel due to its flexibility and softness, so the baby bottle contributes to emotional development of the infant or young child.

Since the silicone baby bottle according to the present invention has a simple structure, it can be produced with good productivity even while it has a good appearance. In addition, the silicone baby bottle according to the present invention do not cause safety accidents which often occur during use of a conventional baby bottles made of silicone (decoupling between the body part and the other components during use, etc).

Since the air inlet is formed in the body part, there is little possibility that the formula is discharged through the air inlet by backflow because the internal pressure in the body part very slightly increases. Furthermore, since the air inlet is covered by the first coupling ring, even if the formula is discharged through the air inlet, the discharged formula may remain between the body part and the first coupling ring, so that the discharged air will not flow along the surface of the body part. Even if the amount of formula discharged through the air inlet is beyond a volume of the formula which can remain in a gap between the body part and the first coupling ring, when an infant or young child sucks the formula again, the formula between the body part and the first coupling ring is reintroduced into the body part. Accordingly, the formula is unlikely to flow along the outside surface of the body part and the infant or young child may not be displeased or infected by germs in the formula flowing along the surface of the body part.

In conclusion, it is possible to provide a silicone baby bottle which is safe and easy to use.

MODE FOR INVENTION

Figure 1:
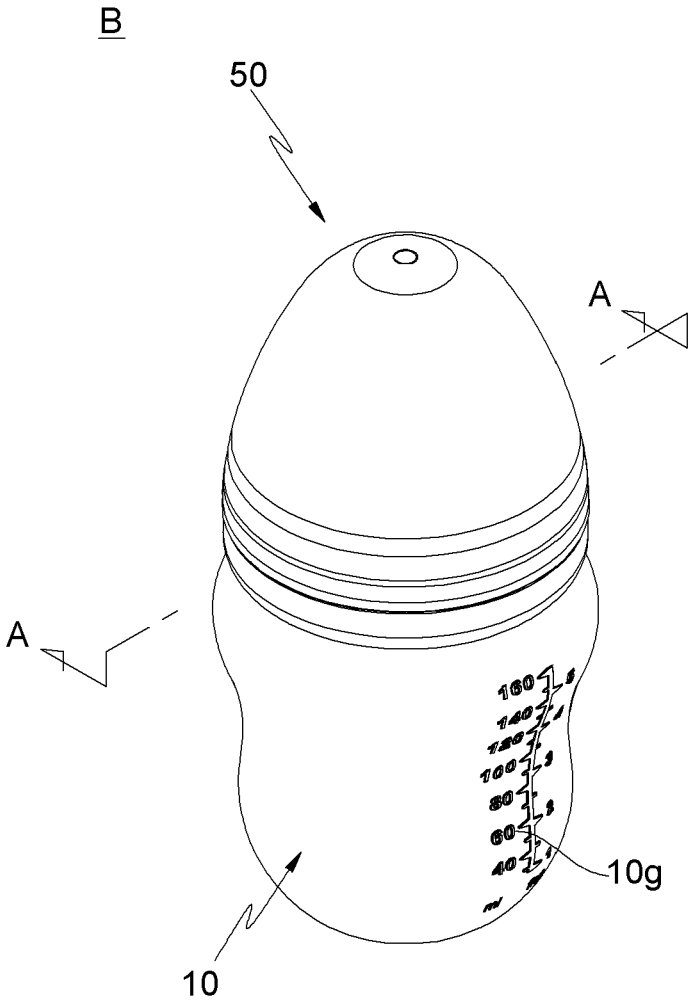
FIG. 1 is a perspective view illustrating a small-size silicone baby bottle according to a first embodiment of the present invention.

Hereinafter, the preferred embodiments of the present invention will be described in detail with reference to the appended drawings.

Since the present invention can undergo various changes and can be embodied in diverse forms, various aspects or embodiments are described in detail hereinbelow. However, the following description is not intended to limit the present invention to particular embodiments disclosed here, and the present invention should be understood to include modifications, equivalents, and alternatives which come under the spirit and technical scope of the present invention.

Reference should now be made to the drawings, in which the same reference numerals particularly in tens digit and units digit, or tens digit, or units digit, and reference signs including alphabetical letters are used throughout the different drawings to designate components having the same or similar functions. Unless stated otherwise, the components denoted by the reference numerals or signs in the drawings are construed to designate the same or similar components or the components having the same or similar functions (especially reference numerals in a first drawing group including FIGS. 1 to 8 according to a first embodiment and a second drawing group including FIGS. 9 to 18 according to a second embodiment differ in hundreds digit).

As for the components in the drawings, although the components are illustrated in an exaggerated, enlarged (increased) or miniaturized (decreased) sizes or thicknesses, or illustrated in a simplified manner in order to help better understand the components, the scope protected by the present invention should not be limitedly construed by the illustrated manner.

The terms used throughout the specification and specific embodiments or aspects described here in the specifications are adopted for the illustrative purpose but are not intended to limit the present invention. Expression of a single component may include expression of plural components. In the present specification, the expressions "include something" or "composed of something" are adopted to express that there is a thing including features, numerals, steps, operations, components, parts, or combinations of those, but should not be construed in such a manner that one or more other features, numerals, steps, operations, components, parts, combinations of those cannot be added or should be excluded from the thing.

Unless defined otherwise, all of the terms used here including technical or scientific terms have the same meanings generally accepted by those ordinarily skilled in the art to which the present invention belongs. Such terms defined in general dictionaries and used here should be interpreted to have meanings as understood in context of related arts but are not interpreted ideally or excessively formally unless explicitly defined in the present specification.

The terms "first", "second", etc. are used only for the purpose of differentiating between components. Accordingly, they are not used to indicate order of preparation steps and may not be in agreement with terms used in the claims.

As for directions which have not been strictly defined here for the purpose of an easy description about a silicone baby bottle according to the present invention, the directions should be understood with reference to FIG. 1. That is, up, down, left, and right portions in FIG. 1 also applied to the other drawings and the description and claims in the same way as in FIG. 1.

All components (for example, a body part and a nipple) which come in contact with formula contained in the silicone baby bottle according to the present invention described in the present specification and claims are made of silicone which is not likely to generate environmental hormones, but the materials of the components are not limited to silicone.

That is, as long as a material has similar features to silicone, i.e., it is not likely to generate environmental hormones and can be disinfected through boiling, the material may be alternatively used instead of silicone. Here, silicone is a representative of elastomer (carbon polymer).

Accordingly, a "silicone" baby bottle categorized by title and claims of the invention is symbolic of various silicones, including elastomer, which are free of hazards, for example, substantially being exposed to environmental hormones usually attributable to synthetic resin.

Figure 2:
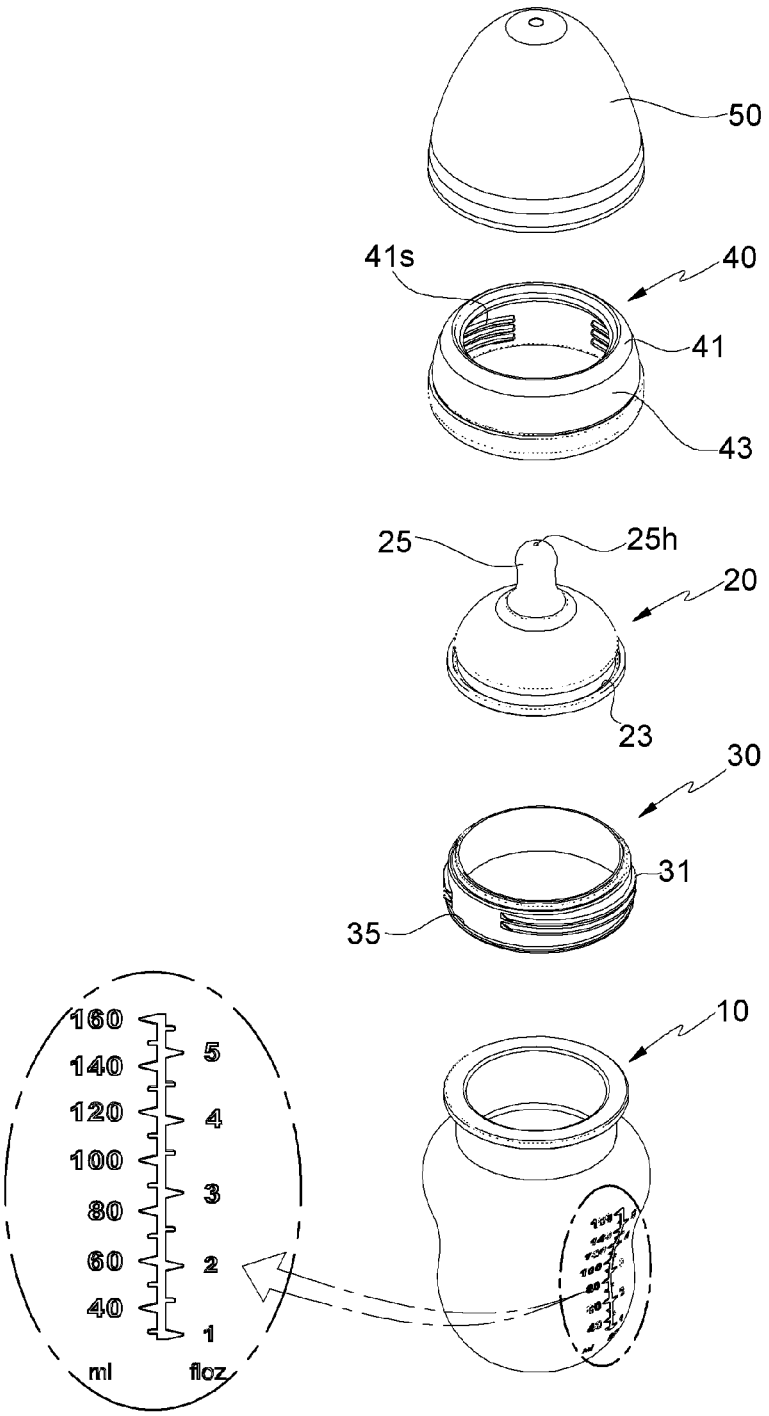
FIG. 2 is an exploded perspective view illustrating the small-size silicone baby bottle according to the first embodiment of the present invention.
Figure 3:
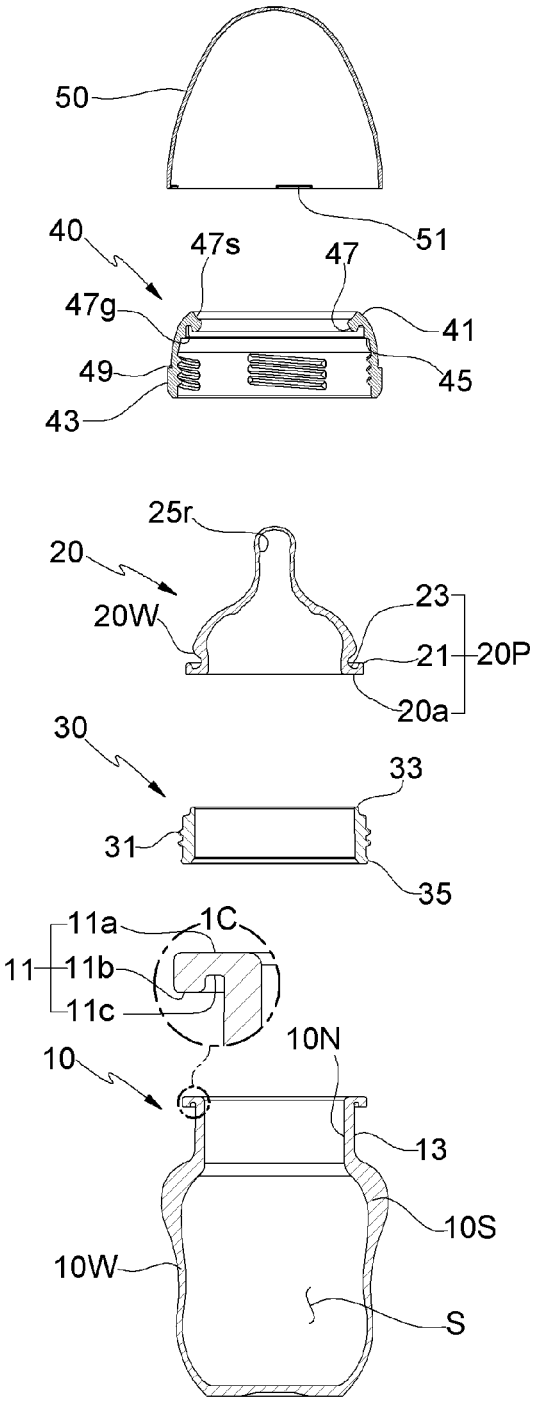
FIG. 3 is a cross-sectional view taken along a line A-A of FIG. 1.

In a first drawing group including FIGS. 1 to 8 according to a first embodiment, FIGS. 1 to 3 illustrate a small-size silicone baby bottle B according to the first embodiment of the present invention, in which FIG. 1 is a perspective view illustrating an assembled state, FIG. 2 is an exploded perspective view, and FIG. 3 is an exploded cross-sectional view taken along a line A-A of FIG. 1.

Figure 4:
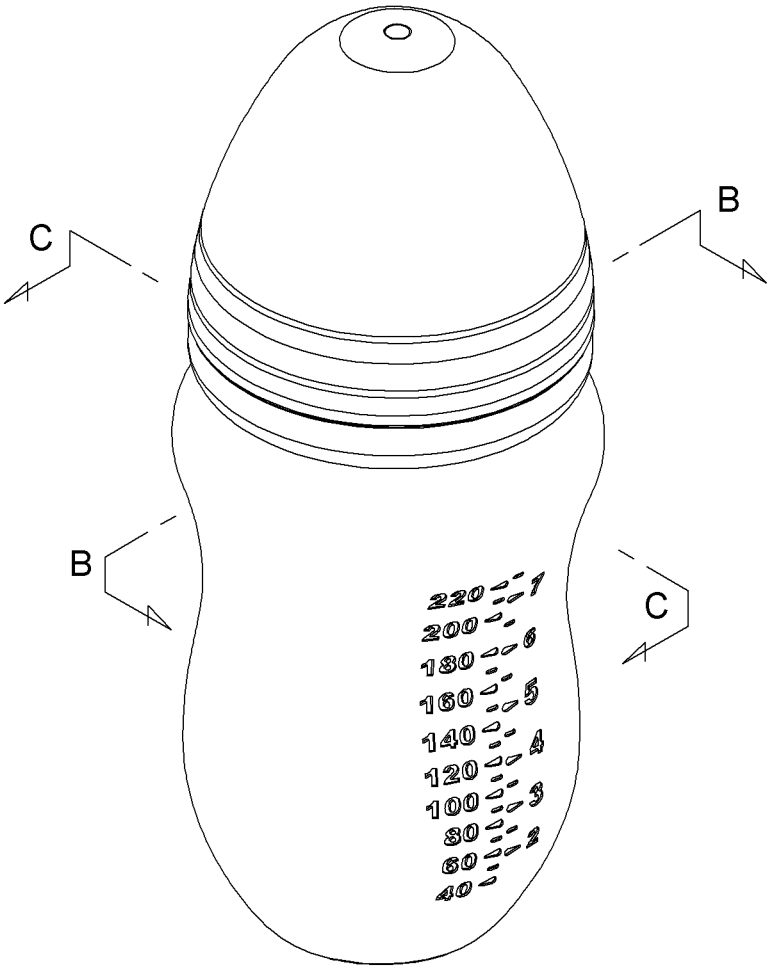
FIG. 4 is a perspective view illustrating a large-size silicone baby bottle according to the first embodiment of the present invention.
Figure 5:
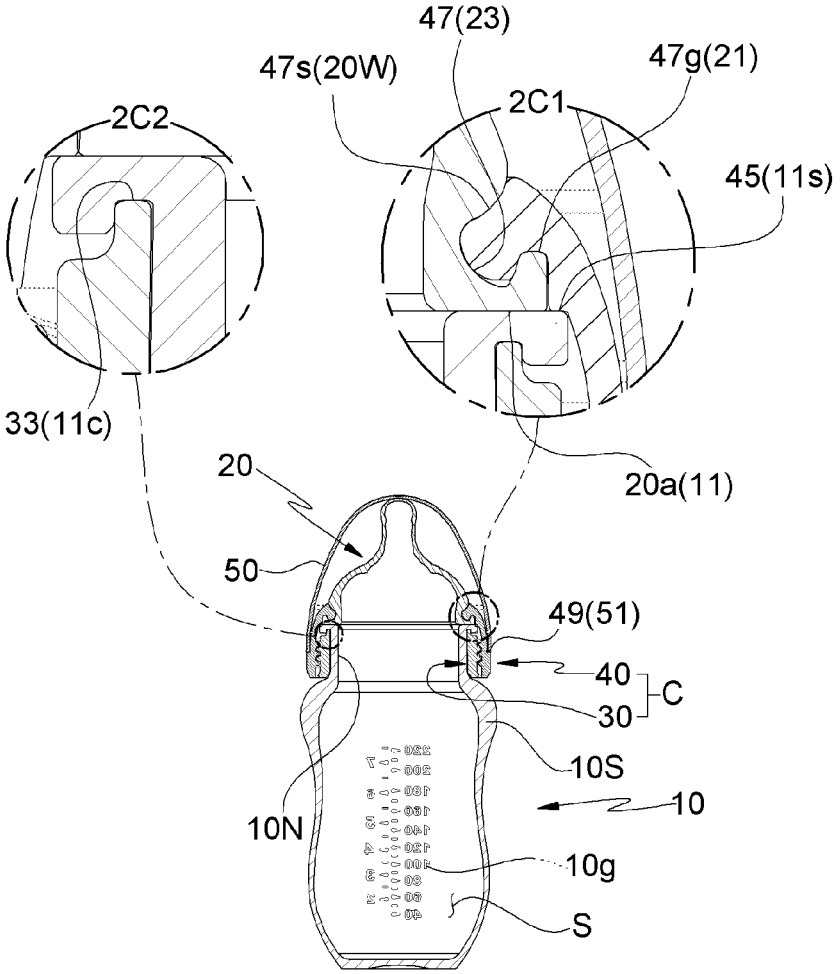
FIG. 5 is a cross-sectional view taken along a line B-B of FIG. 4.
Figure 6:
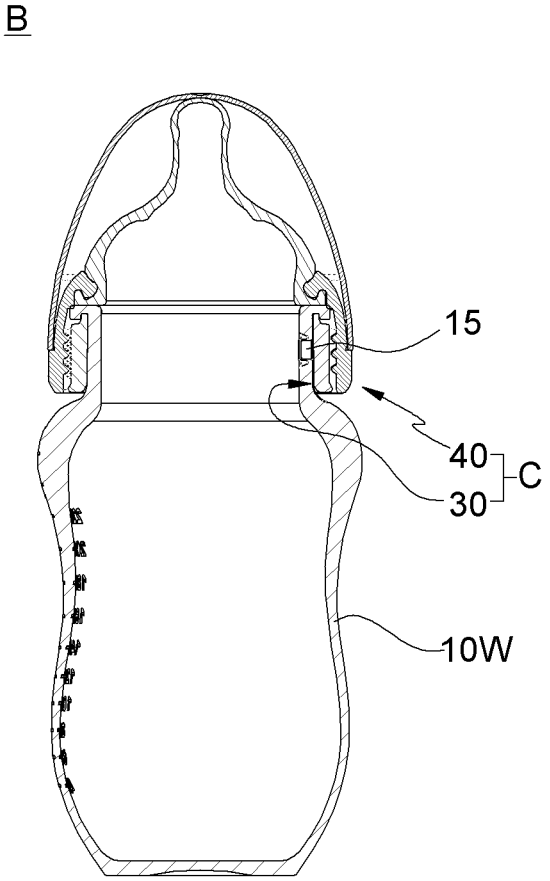
FIG. 6 is a cross-sectional view taken along a line C-C of FIG. 4.

FIGS. 4 and 6 illustrate a large-size silicone baby bottle B according to the first embodiment of the present invention, in which FIG. 4 is a perspective view illustrating an assembled state, FIG. 5 is a cross-sectional view illustrating the assembled state and taken along a line B-B of FIG. 4, and FIG. 6 is a cross-sectional view illustrating the assembled state and taken along a line C-C of FIG. 4.

Figure 7:
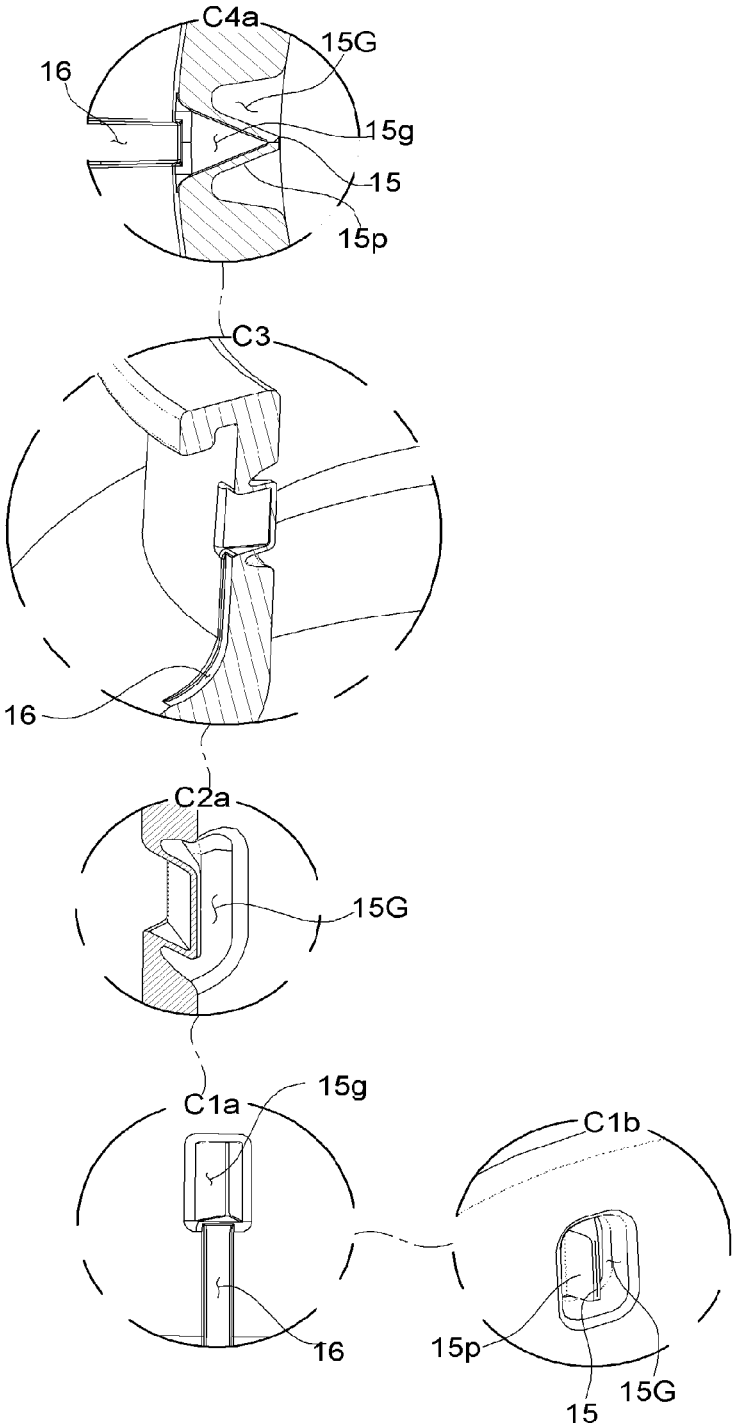
FIG. 7 is a view illustrating a periphery portion of an air inlet 15 of a body part of the silicone baby bottle shown in FIG. 6.

FIG. 7 illustrates the vicinity of an air inlet 15 of a body part 10 of the silicone baby bottle B of FIG. 6 and provides views viewed from various observation angles.

A circle C1*a* illustrated by an alternate long and short dash line shows the external appearance of a body part 10 of a baby bottle, especially the vicinity of a guide recess 16 and an inlet for allowing external air to be introduced into the baby bottle when an infant or young child sucks formula in the baby bottle, and a circle C1*b* illustrated by an alternate long and short dash line shows the internal appearance of the body part 10 of the baby bottle, especially in the vicinity of the air inlet 15.

A circle C2*a* illustrated by an alternate long and short dash line is a perspective cross-sectional view illustrating the external appearance of a main part of the baby bottle, which is vertically cut along an axis of the air inlet 15 in a slit shape.

A circle C3 illustrated by an alternate long and short dash line is a perspective vertical cross-sectional view which illustrates the external appearance of a main part of the slit-like air inlet 15 and the guide recess 16.

A circle C4*a* illustrated by an alternate long and short dash line is a flat cross-sectional view which is taken along a horizontal line passing by the air inlet 15 and which illustrates a main part of the slit-like air inlet 15.

Figure 8:
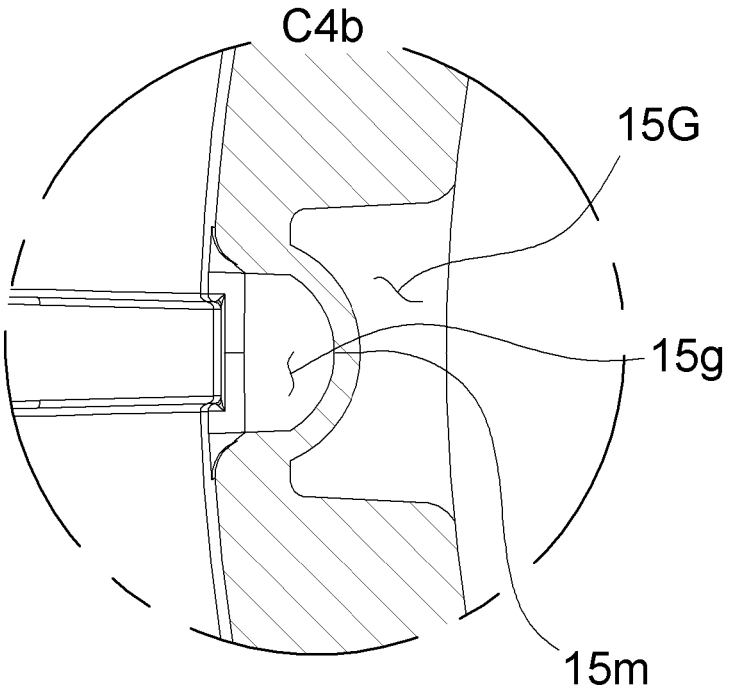
FIG. 8 is a diagram illustrating an air inlet according to a modification and is a view corresponding C4*a* of FIG. 7.
Figure 9:
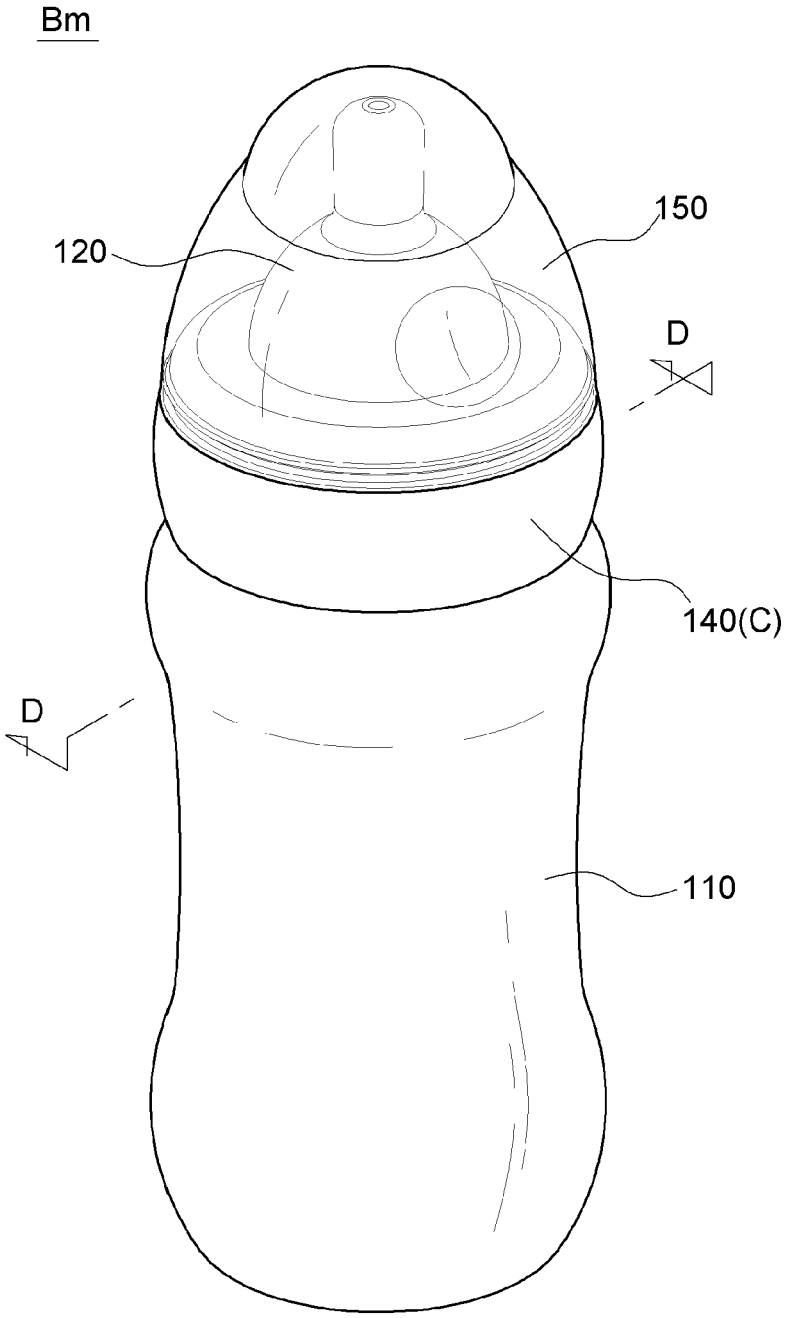
FIG. 9 is a perspective view illustrating a silicone baby bottle according to a second embodiment of the present invention.

A circle C4*b* illustrated by an alternate long and short dash line shown in FIG. 8 is a flat cross-sectional view which is taken along a horizontal line passing by the air inlet 15 and which illustrates a circular air inlet 15*m* which is a modification to the slit-type air inlet 15.

As illustrated in FIGS. 1 and 6, the silicone baby bottle B according to the present invention may have a large-size or small-size body part 10 selected depending on baby's intake which usually varies depending on the baby's age.

The body part and nipple of the silicone baby bottle according to the present invention are made of a health-friendly material such as silicone so that a baby will not be exposed to hazards such as environmental hormones. Furthermore, because of flexibility which is an advantageous property of elastomer, the silicone baby bottle has mother's skin-like texture, contributing to the baby's emotional development.

The body part and nipple which are flexible and made of silicone are in tight contact with each other when assembled and the body part and nipple can be assembled and disassembled in a simple manner using a coupling means.

The coupling means includes a first coupling ring and a second coupling ring. The body part and nipple are in tight pressure contact with each other and the contact structure is stable when assembled.

There is no chance that the first and second coupling rings come into contact with the contents such as infant formula, or with baby's mouth. The body part 10 has an inside space S, and gradations 10*g* are marked on the outer surface in order to enable gauging of infant formula (see FIG. 2). As can be seen from a front view illustrated within an alternate long and short dash line, the gradations on the left side can gauge up to 10 ml in which the scale interval is "ml" and the gradations on the right side allows gauging in unit of "fl oz" (used in U.S. and meaning fluid ounce) in which the scale interval is 0.5 fl oz (about 14.2 ml).

The body part has a gentle curve overall. A waist portion 10W of the body part is recessed. This recessed waist portion and frictional texture, which is a characteristic of silicone, allow a baby to intake the infant formula, easily grabbing the baby bottle for himself/herself. That is, the silicone baby bottle has an ergonomic structure.

The body part 10 has a shoulder portion 10S having an expanded outer diameter and extending from an upper end of the waist portion 10W, and a neck portion 10N extending from an upper end of the shoulder portion 10S.

The outside surface of the neck portion 10N is provided with a mounting recess 13 in which a first coupling ring 30 among coupling rings 30 and 40, which constitute a coupling means C, is disposed. An upper locking portion 11 is formed at an upper end portion of the mounting recess 13 in order to restrict upward movement of the first coupling ring and prevent removal of the first coupling ring.

Regarding the neck portion, the shape and inner and outer diameters do not matter. The neck portion is important in terms of providing a mounting portion to which the first coupling is mounted. That is, the neck portion should not be interpreted to limit the present invention in terms of lexical-semantic aspect but be considered in terms of functional aspect.

The nipple 20 includes a flange 20P which comes into contact with an upper surface of the body part, i.e., the upper locking portion 11, and which provides a coupling site to be combined a second coupling ring 40 among the coupling rings 30 and 40 constituting the coupling means C.

In the nipple 20, a waist portion 20W extends upward from an upper end of the flange 20P and a tap 25 is disposed at a side of the waist portion 20W. A discharge hole 25*h* is formed on top of the tap 20 so that infant formula in the baby bottle can be discharged.

As can be seen from the sectional view of FIG. 3, one or more reinforcement rings 25 are formed in a sufficient thickness on the inside circumferential surface of the tap 25. Because of the reinforcement rings 25*r* having high elasticity, the nipple can promptly expand after being contracted by baby's suction.

The first coupling ring 30 of the coupling means C is combined with the neck portion 10N of the body part 10. That is, the mounting recess 13 of the neck portion 10N comes into contact with an inside surface of the first coupling ring 30 and is provided with male threads 31.

The second coupling ring 40 of the coupling means C is combined with the flange 20P of the nipple 20.

The second coupling ring 40 includes a locking portion 41 covering the upper surface of the flange 20P and a skirt 43 extending downward from a lower surface of the locking portion 41.

An inside surface of the skirt 43 is provided with female threads 41*s* which are screwed with the male threads of the first coupling ring.

Next, more specifically, the tightly combined structure of the body part, the first coupling ring, the nipple, and the second coupling ring are described. That is, the coupling means for tightly coupling the body part and the nipple will be described in detail.

The upper locking portion 11 provided at an upper end of the neck portion 10N of the body part 10 includes a side extension 11*a* extending in a radial direction from an upper end of the body part and a lower extension 11*b* protruding downward from an end of the side extension and covering an upper end of the first coupling ring 30. The upper end of the first coupling ring 30 is locked by the upper locking portion 11 of the body part.

The first coupling ring 30 is disposed between the shoulder portion 10S having an outer diameter larger than that of the neck portion 10N and the upper locking portion 11 protruding outward from the neck portion 10N. For this reason, the first coupling ring 30 will be restricted in upward movement and will be prevented from being removed. That is the first coupling ring 30 will be fixed in place in an assembled state.

The first coupling ring 30 has an insertion portion 33 at the upper end thereof. Meanwhile, an inside surface of the lower extension of the upper locking portion 11 is provided with a recessed portion 11*c* into which the insertion portion 33 is inserted. Accordingly, the first coupling ring 30 remains assembled, and does not freely move (refer to the inside of the circle of 1C of the alternate long and short dash line in FIG. 3 and the enlarged cross-sectional view illustrated in the circle 2C2 of the alternate long and short dash line in FIG. 5).

A coupling direction indicating mark is formed on the first coupling ring 30 so that the first coupling ring 30 can be reassembled with the second coupling ring 40 easily and correctly without confusing the male threads and female threads after being disassembled for cleaning and disinfection.

The coupling direction indicating mark is a ring-shaped coupling protrusion 35 protruding downward from a lower end of the first coupling ring. An outside diameter of the coupling protrusion is larger than an inside diameter of the second coupling ring 40 so that reversed coupling is prevented from the first. In a position in which the coupling protrusion 35 faces down, the first coupling ring 30 is assembled with the neck portion 10N of the body 10. Accordingly, upside-down assembling is prevented.

Next, in the nipple 20, a recess 23 is formed between the flange 20P and the waist portion 20W. The second coupling ring 40 has a pushing portion 47 which is inserted into the recess 23.

The pushing portion 47 of the second ring 40 protrudes from an inside surface of the second ring.

As can be seen from an enlarged cross-sectional view inside the circle 2C1 illustrated by an alternated long and short dash line of FIG. 5, an upper surface of an inner portion of the pushing portion 47 of the second coupling ring 40 is provided with a pressed portion 47*s* which is pressed by the lower end of the waist portion 20W of the nipple 20.

In addition, a protrusion 21 of the flange 20P is inserted into a coupling recess 47*g* formed in a lower surface of the pushing portion 47 of the second coupling ring 40 so that the nipple 20 and the second coupling ring 40 can be firmly combined.

In addition, when assembling a first structure in which the body part and the first coupling ring are coupled with a second structure in which the nipple and second coupling ring are coupled to produce the baby bottle B, pressing force may be applied such that a contact surface 20*a* of the lower surface of the flange 20P of the nipple 20 surely comes in tight contact with the upper surface of the upper locking portion 11 of the body part 10.

As can be seen from an enlarged cross-sectional view in the circuit 2C1 of the alternate long and short dash line of FIG. 5, the firmly assembled structure of the silicon baby bottle B according to the present invention coupling is ensured not only by the tight pressure contact between the contact surface 20*a* of the lower surface of the flange 20P of the and the upper surface of the upper locking portion 11 of the body part 10, but also by a structure in which the inside surface of the second coupling ring 40 is provided with a pressing portion 45 which directly presses the upper locking portion 11 of the neck portion 10N of the body part 10, and the pressing portion 45 presses a portion other than the contact portion between the contact surface 20*a* and the locking portion 11, i.e., the pushing portion 11*s* formed on the upper surface of the lower extension 11*b*, when the second coupling ring 40 is combined with the first coupling ring 30.

Since the pressing portion 45 presses a portion other than the contact portion between the contact surface 20*a* and the locking portion 11, i.e., the pushing portion 11*s* formed on the upper surface of the lower extension 11*b*, tight sealing is further ensured.

The shoulder portion 10S of the body part 10 is relatively thick compared with the other portion of the body part 10 in order to impart rigidity and reinforce supportability of the body part 10 while enabling the body part 10 to have a soft texture (mother's skin-like feel) and reducing usage of material. The shoulder portion 10S having a relatively large thickness compared with the other portions imparts a shape-keeping characteristic to the body part 10.

In order to combine the first structure in which the body part and the first coupling ring are coupled with the second structure in which the nipple and the second coupling ring are coupled in a screw manner, a user holds the first coupling ring 30 and second coupling ring 40 (one in each hand) and rotates then in opposite directions. When the first coupling ring 30 and second coupling ring 40 are rotated sufficiently, the contact surface of the lower surface of the flange 20P and the upper locking portion 11 of the body part 10 are deformed to primarily secure tight sealing, and the pressing portion 45 of the second coupling ring 40 is deformed by pressing the pushing portion 11*s* to secondarily secure the tight sealing.

In this case, the thickly formed shoulder portion which imparts the shape-keeping characteristic prevents an accident in which the body part 10 cannot maintain its original shape due to excessive force applied thereto and as a result the contents such as infant formula leaks from the internal space S of the body part, making the outer surface of the bottle dirty and causing the user to be burnt.

The waist portion 20W of the nipple 20 is also thickly formed compared with the other portions of the nipple 20 similarly in order to impart rigidity (i.e., shape-keeping characteristic) to the nipple 20 and reinforce supportability of the nipple 20 while allowing the soft tap 25 to elastically contract and expand to discharge the infant formula, ensuring tight sealing by deformation of the flange 20P, and preventing waste of material.

For this reason, when the first structure in which the body part and the first coupling ring are coupled and the second structure in which the nipple and the second coupling ring are screwed with each other, i.e., when the first coupling ring 30 and second coupling ring 40 are rotated fully in opposite directions, the thickly formed waist portion of the nipple 20 also functions to provide supportability and enables the primary and secondary contact portions (20*a* and 11) and (45 and 11*s*) to be tightly sealed.

In the neck portion 10N of the body part 10, an air inlet 15 allowing air introduction during feeding is formed in the mounting recess 13*a* surrounded by the first coupling ring 30.

With reference to FIG. 7, the air inlet 15 is illustrated in the inside of the circles C1*a*, C1*b*, C2*a*, C2*b*, C3, and C4*a* illustrated by alternate long and short lines.

A guide recess 16 extending from a lower portion of the first coupling rig 30, i.e., extending from an upper portion of the shoulder portion 10S is formed in order to enable the air to be smoothly introduced through the air inlet even when the mounting recess 13 of the neck portion 10N of the body part 10 and the inside surface of the first coupling 30 are in tight contact.

According to the present invention, the air inlet 15 is formed in the neck portion 10N of the body part 10 and covered by the first coupling ring 30 so that it is free from contact with the outside, for example, baby's hand or user's (i.e. parents') hand and does not become dirty.

Furthermore, the air inlet functions like a valve which opens and closes for itself because of the elastic characteristic of the material of the body part.

Yet furthermore, since the air inlet 15 is formed in the top of an air inlet protrusion 15*b*. The inside and outside circumferential surfaces of the air inlet protrusion 15*p* are surrounded by a barrier recess 15G and an air inlet recess 15*g*, respectively. Accordingly, elastic motion of the air inlet 15 is not limited but smooth and sensitively occurs. Furthermore, the barrier recess 15G and the air inlet recess 15*g* enable easy cleaning of the air inlet 15 and the air inlet protrusion 15*p*. Accordingly, the silicone baby bottle according to the present is also advantageous in terms of sanitation.

The characteristic structure of the air inlet is described in detail below.

The air inlet 15 having a slit shape is formed in the tip of the air inlet protrusion 15*p* protruding inward in the body part 10.

The air inlet protrusion 15*p* has the air inlet recess 15*g* which is concave when viewed from outside the bottle and which communicates with the guide recess 16.

The contact between the mounting recess 13 of the neck portion 10N of the body part 10 and the inside surface of the first coupling ring 30 is not maintained at a location where the guide recess 16 and the air inlet recess 15*g* are disposed but allows for a gap so that air can be smoothly introduced into the bottle through the gap.

When the air inlet 15 is observed from the inside, the air inlet protrusion 15*p* with the tip, in which the air inlet 15 is formed, is formed within the barrier recess 15G. When a baby (or infant or young child) sucks the contents such as infant formula from the bottle, the slit-like air inlet 15 is opened and air can be smoothly introduced into the bottle.

The structure illustrated in the circle C4*b* by an alternate long and short dash line in FIG. 8 is a circular air inlet 15*m* which is a modification to the air inlet of the present embodiment. This means that the shape and number of the air inlets can be diversely selected.

A cap 50 for protecting the nipple 20 has a locking protrusion 51 on an inside surface of a lower portion thereof.

With reference to FIG. 3, a plurality of non-continuous locking protrusions (or a continuous locking protrusion) are forcedly inserted and fitted into a coupling sill 49 formed on the outside surface of the lower end of the skirt 43 of the second coupling ring 40 so that the coupling between the second coupling ring 40 and the cap 50 is maintained.

Next, the second drawing group including FIGS. 9 to 18 according to a second embodiment is described.

With reference to the second drawing group, a silicone baby bottle Bm according to the second embodiment includes components of a body part 110, a nipple 120, and a coupling unit 130, 140.

The body part 110 is made of silicone and has a cylinder shape with a closed bottom so that infant formula can be contained in the body part 110.

Gradations (not shown) are marked on an outside surface of the body part 110 to measure the volume of the infant formula contained in the body part 110. The surface of the body part 110 is embossed for the purpose of anti-slipping.

An upper locking portion 111 protrudes outward from an outside circumferential surface of an upper end portion of the body part 110 and a first coupling ring 130 of the coupling means 130, 140 engages with the upper locking portion 111.

A mounting recess 113 is formed under the upper locking portion 111, and the first coupling ring 130 is inserted into and mounted to the mounting recess 113.

When the first coupling ring 130 is mounted to the mounting recess 113 of the body part 110, an upper end of the first coupling ring 130 is locked by the upper locking portion 111 at the same time as mounting of the first coupling ring 130.

An outside surface of the first coupling ring is provided with a thread. After the first coupling ring 130 is inserted into the mounting recess 113 of the body part 110, a second coupling 140 which is combined with the nipple 120 in advance, is screwed with the first coupling ring 130.

The coupling between the second coupling ring 140 and the first coupling ring 130 is not limited to the screw manner. The second coupling ring 140 and the first coupling ring 130 may be coupled in various manners.

Figure 12:
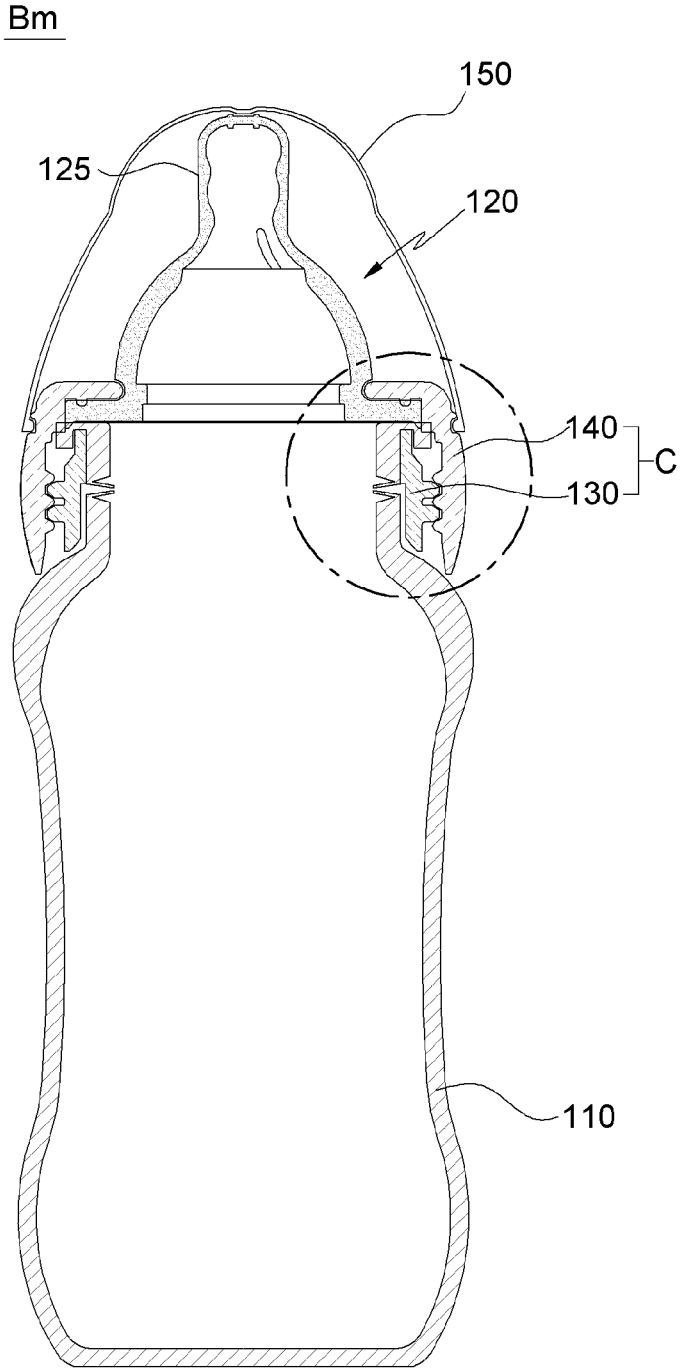
FIG. 12 is a cross-sectional view taken along a line D-D of FIG. 9.
Figure 13:
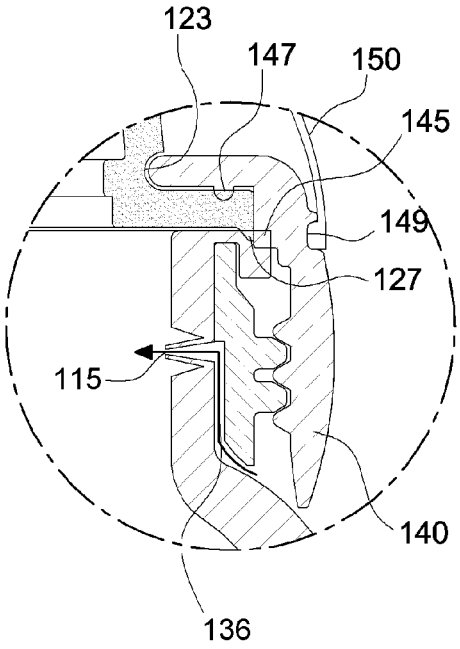
FIG. 13 is an enlarged view illustrating a circled portion in FIG. 12.

Next, as soon as the first coupling ring 130 and the second coupling ring 140 are coupled to each other, the inside surface of the second coupling ring 140 presses the nipple 120 and an upper end portion (i.e. more specifically the upper locking portion 111) of the body part 110 (see FIGS. 12 and 13).

The pressing of the second coupling 140 against the body part 110 and the nipple 120 enables a tight contact between the body part and the nipple.

As described above in the description about the background art, due to the characteristic of silicone such as elastomer, the components can be easily disassembled by external force after being assembled, which is likely to lead to safety accidents.

That is, if a user presses the body part 110 from the top in a state in which the components of the baby bottle are assembled, an upper portion of the body part pressed by the user is easily deformed and collapsed inwards. In this incidence, the first coupling ring 130 inserted in the mounting recess of the body part is easily separated from the body part and the components of the baby bottle fall apart from each other.

Accordingly, the present invention provides a novel coupling structure which can solve the above problems arising in the conventional art. The coupling structure provided by the present invention has an advantage of enabling mass production of the baby bottle and improving appearance in a sense of design.

Figure 14:
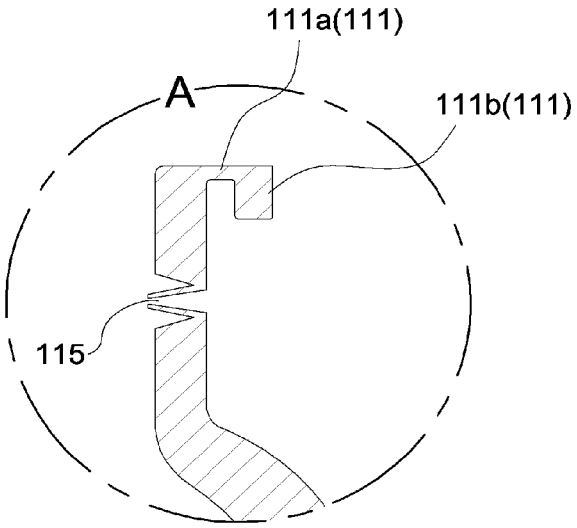
FIG. 14 is a cross-sectional view illustrating only the body part of the silicone baby bottle of FIG. 13.

For this purpose, the upper locking portion 111 includes a side extension 111*a* extending outward from an upper end of the body part and a lower extension 111*b* protruding downward from an end of the side extension and surrounding the outer surface of the first coupling ring 130 (see FIGS. 12, 13, and 14).

The second coupling ring 140 has a pressing portion 145 which presses an upper surface of the lower extension 111*b*. Depending on the size or position of the pressing portion 145, only the lower extension is pressed, only the side extension is pressed, or both of the lower extension and side extension are pressed (see FIGS. 12 and 13).

The pressing portion 145 of the second coupling ring 140 presses the lower extension 111*b* in a state in which the lower extension 111*b* of the body part 110 surrounds the external surface of the first coupling ring 130.

Accordingly, even with external force applied to top of the body part 110, the first coupling ring 130 is not easily removed from the body part 110 so that the components of the baby bottle will not separate or fall apart. That is, the infant formula in the body part will not be spilled.

The nipple 120 made of the same material as the body part will be described below.

The nipple includes a flange 121 to be placed on the upper surface of the upper locking portion of the body part, and a tap 125 protruding upward from an upper surface of the flange.

A recess 123 with which the second coupling ring 140 is engaged is formed in a surface of the tap 125 so that the second coupling ring 140 and the nipple 120 can be combined with each other.

The second coupling ring 140 covers the upper surface of the flange 121 of the nipple when it is coupled to the first coupling ring 130.

Besides the pressing portion 145, the second coupling ring is further provided with a pushing portion 147 for pressing the upper surface of the flange 121 in order to obtain a more stable sealing structure (see FIGS. 12 and 13).

That is, since the second coupling ring 140 is provided with the pressing portion 147 on the inside surface which comes into contact with the upper surface of the flange 121, when the first coupling ring 130 and the second coupling ring 140 are coupled to each other, the pressing portion 147 presses the upper surface of the flange 121.

According to this structure, in a state in which the body part 110 and the first coupling ring 130 are assembled, the pressing portion 145 first presses the surface of the upper surface of the lower extension 111*b* and then the pushing portion 147 presses the upper surface of the flange 121 of the nipple 120.

In this way, the components are stably and effectively assembled.

In the nipple 120, a pushing portion 127 is formed to protrude downward from a bottom surface at the periphery of the flange 121 (see FIGS. 12 and 13).

When the first coupling 130 and second coupling ring 140 are coupled to each other, the pushing portion 127 also presses the upper surface of the upper locking portion 111 so that the components can be firmly coupled to each other.

The second coupling ring 140 includes a locking portion 141 and a skirt 143 extending downward from the locking portion 141.

The locking portion 141 of the second coupling ring 140 covers the upper surface of the flange 121 of the nipple 120, and the skirt 143 of the second coupling ring covers the periphery of the first coupling ring 130. The inside surface of the second coupling ring 140 is provided with a thread to be screwed to the thread formed on the outside surface of the first coupling ring 130.

The pushing portion 147 of the second coupling ring 140 is formed on the bottom of the locking portion 141.

The pressing portion 145 is a protrusion which protrudes inward from an inside surface of the second coupling ring, in a position between the locking portion 141 and the skirt 143.

Returning back to the description of the body part 110, a plurality of air inlets 115 are formed in the mounting recess 113 in order to allow external air to be introduced into the body part 110.

The air inlet 115 is tapered toward the inside of the body part. Because of the tapered structure with a narrow interior and a broad exterior, external air can be easily introduced into the body part of the bottle but the infant formula contained in the body part of the bottle cannot be easily discharged.

Figure 15:
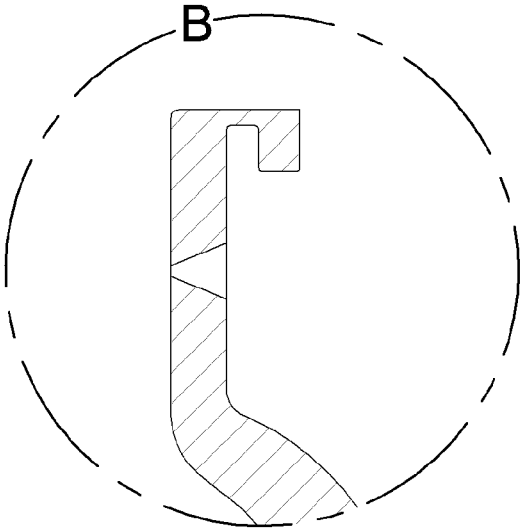
FIG. 15 is a cross-sectional view illustrating an air inlet of the silicone baby bottle according to a modification to one shown in FIG. 14.

FIG. 15 illustrates the structure of the air inlet 115 according to one modification within the circle but the structure of the air inlet 115 is not limited thereto.

A gap 116 is provided between the mounting recess 113 and the first coupling ring 130 so that external air can be introduced into the body part through the air inlet 115. Alternatively, a channel 136 is formed only in a portion of the first coupling ring 130 in order to boost air introduction through the air inlet 115.

Figure 10:
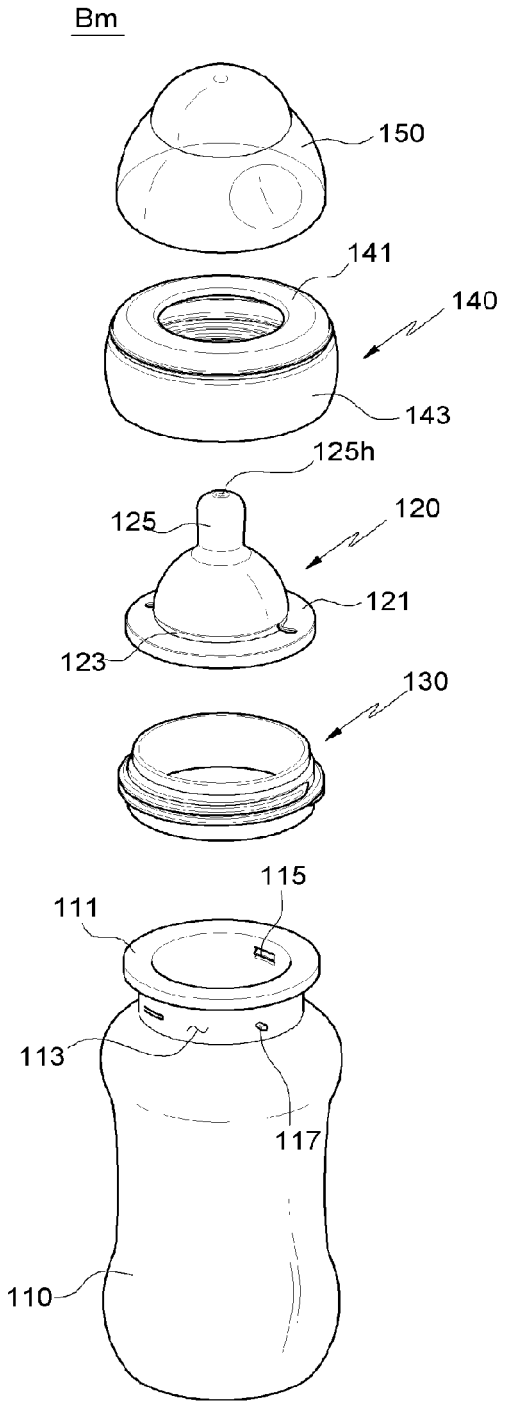
FIG. 10 is an exploded perspective view illustrating the silicone baby bottle according to the second embodiment of the present invention.
Figure 11:
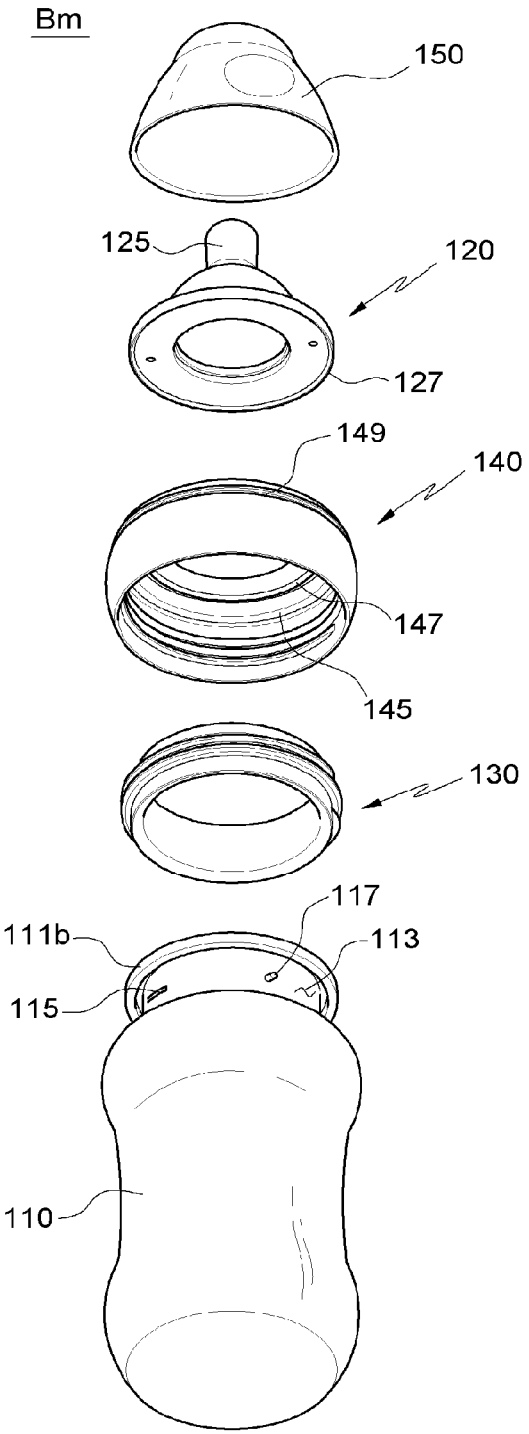
FIG. 11 is an exploded perspective view of the silicone baby bottle according to the second embodiment of the present invention, which is viewed at a different angle.
Figure 16:
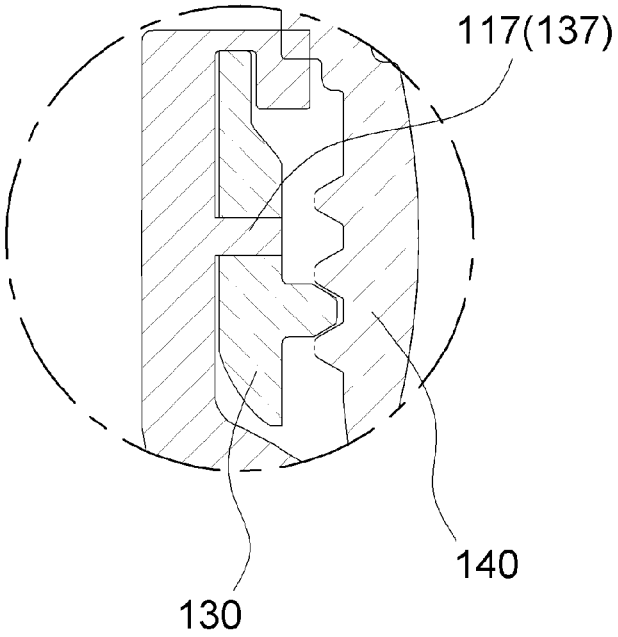
FIG. 16 is a cross-sectional view illustrating a main part of the silicone baby bottle according to the second embodiment of the present invention, in an assembled state in which a first coupling ring is fitted into a mounting recess which is provided with an insertion protrusion.

The bottom surface of the mounting recess 113 is provided with a plurality of insertion protrusions 117 to be inserted into insertion holes 137 formed in the first coupling ring 130 (see FIGS. 10, 11, and 16).

The insertion protrusions 117 are inserted into the insertion holes 137. For this reason, when screwing the first coupling ring 130 which is combined with the body part 110 in advance with the second coupling ring 140 or unscrewing the first coupling ring 130 from the second coupling ring 140 by holding and rotating the body part 110 and the second coupling ring 140 in opposite directions, it is possible to prevent the first coupling ring 130 from rotating along with rotation of the body part 110, or to prevent the first coupling ring 130 from rotating along with rotation of the second coupling ring 140. That is, unintentional rotation of the body part 110 and the first coupling ring 130 is prevented.

That is, such a structure makes the first coupling ring 130 and the second coupling ring smoothly screwed together or unscrewed from each other.

Figure 17:
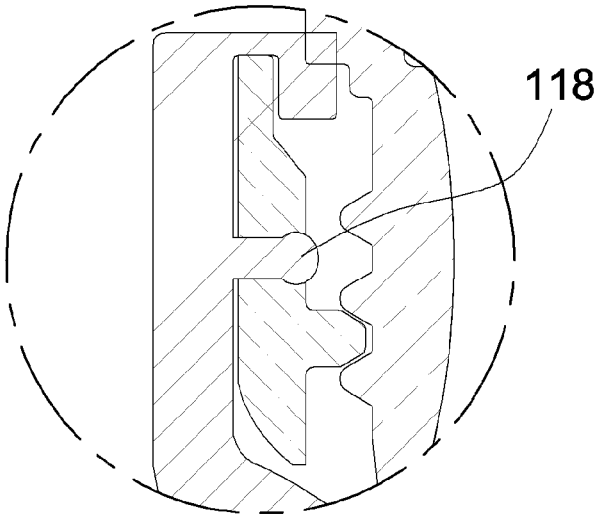
FIG. 17 is a view of an insertion protrusion according to a modification to one shown in FIG. 16.
Figure 18:
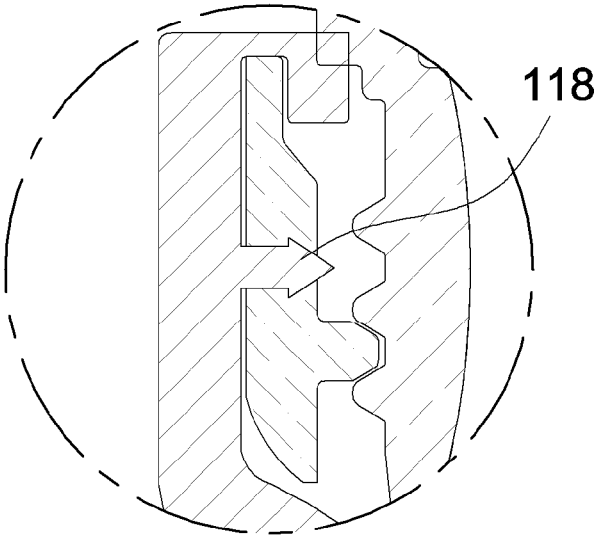
FIG. 18 is a view of an insertion protrusion according to another modification to the one shown in FIG. 17.

As illustrated in FIGS. 17 and 18, according to one modification, the insertion protrusion 117 may be provided with a bulging portion 117. When the bulging portion 118 is inserted into the insertion hole 137, it is hooked by a periphery portion of the first coupling ring 130. Since the insertion protrusion 117 and the bulging portion 118 are formed of silicone and thus deformable and flexible, the bulging portion 118 having a larger diameter than the insertion hole 137 can be inserted into and removed from the insertion hole 137.

The bulging portion 118 increases the coupling force between the body part 110 and the first coupling ring 130 and keeps the mounting recess 113 of the body part 110 from separating from the inside surface of the first coupling ring by preventing deformation of the mounting recess 113 of the body part 110 when the body part 110 is deformed by external force of user's hand when the user holds the body part 110 in order to screw or unscrew the first coupling ring 130 and the second coupling ring 140.

This also presents the upper end of the body part 110 from being misaligned with the lower end of the nipple 120, resulting in a gap between the body part 110 and the nipple 120, in the process that the first coupling ring 130 and the second coupling ring 140 are screwed or unscrewed. That is, the upper end of the body part 110 and the lower end of the nipple 120 can be securely sealed and the infant formula will not leak.

As described above, according to the structure of the body part 110, as illustrated in FIG. 12, preferably an upper portion of the body part is formed to be relatively thick compared with a lower portion. This structure reduces deformation of the body part 110 due to the external force from user's hands when the first coupling ring 130 and the second coupling ring 140 are screwed or unscrewed, and prevents a gap from being formed between the body part 110 and the nipple 120.

The nipple 120 is enclosed in the cap 150 so as not to be exposed to the outside.

The cap 150 is coupled to the second coupling ring 140 by a coupling sill formed in the skirt 143 of the second coupling ring 140.

Although a description about physical properties of the tap such as elasticity is omitted here, a person ordinarily skilled in the art will easily appreciate, infer, and reproduce them.

Although a silicone baby bottle having a specific shape and structure has been described with reference to the appended drawings for illustrative purposes, those skilled in the art will appreciate that various modifications, additions and substitutions are possible, without departing from the scope and spirit of the invention as disclosed in the accompanying claims.

The invention claimed is:

1. A silicone baby bottle comprising:

a body part made of elastomer, the body part including a neck portion with an upper locking portion, and a shoulder portion extending from a lower end of the neck portion;

a nipple made of elastomer, the nipple including a flange coming into contact with an upper surface of the body part, a waist portion extending upward from an upper portion of the flange, and a tap extending upward from an upper portion of the waist portion; and a coupling unit which couples the body part and the nipple to each other and which includes a first coupling ring coupled to the neck portion of the body part and a second coupling ring screwed with the first coupling ring and structured to cover an upper surface of the flange of the nipple, wherein the first coupling ring is provided between the shoulder portion and the neck portion of the body part, wherein the neck portion of the body part is provided with an air inlet, through which external air is introduced into the body part during feeding, in a mounting recess which is covered by the first coupling ring, wherein the air inlet is formed in a tip of an air inlet protrusion, and wherein an inside surface and an outside surface of the air inlet protrusion are surrounded by a barrier recess and an air inlet recess, respectively.

2. The silicone baby bottle according to claim 1, wherein the air inlet functions as a valve that closes and opens for itself because the air inlet is made of a material having elasticity.

3. The silicone baby bottle according to claim 1, wherein the nipple has a recess between the flange and the waist portion in the nipple, and the second coupling ring is provided with a pushing portion which is inserted into the recess.

4. The silicone baby bottle according to claim 3, wherein the pushing portion of the second coupling ring protrudes inward from an inside surface of the coupling ring, and the pushing portion is disposed between a lower portion of the waist portion of the nipple and the recess.

5. The silicone baby bottle according to claim 1, wherein the waist portion is thicker than a remaining portion of the nipple in order to impart rigidity and reinforce supportability of the nipple.

6. The silicone baby bottle according to claim 1, wherein the upper locking portion of the neck portion of the body part includes a side extension extending in a radial direction from an upper portion of the body part, and a lower extension protruding downward from a lower end of the side extension and surrounding an upper end of the first coupling ring, and the upper end of the first coupling ring is locked by the upper locking portion of the body part.

7. The silicone baby bottle according to claim 6, wherein the first coupling ring has an insertion portion at the upper end, and an inside surface of the side extension of the upper locking portion of the body part is provided with a recessed portion into which the insertion portion is inserted.

8. The silicone baby bottle according to claim 1, wherein the shoulder portion of the body part is thicker than a remaining portion of the body part in order to impart rigidity and reinforce supportability of the body part.

9. The silicone baby bottle according to claim 1, wherein an inside surface of the second coupling ring is provided with a pressing portion which directly presses the upper locking portion of the neck portion of the body part when the second coupling ring is coupled.

10. The silicone baby bottle according to claim 1, wherein the first ring is provided with a coupling direction indicating mark.

* * * * *